US009520042B2

(12) United States Patent
Eck

(10) Patent No.: US 9,520,042 B2
(45) Date of Patent: Dec. 13, 2016

(54) SMOKE DETECTOR WITH ENHANCED AUDIO AND COMMUNICATIONS CAPABILITIES

(71) Applicant: Microchip Technology Incorporated, Chandler, AZ (US)

(72) Inventor: Arthur B. Eck, Gilbert, AZ (US)

(73) Assignee: MICROCHIP TECHNOLOGY INCORPORATED, Chandler, AZ (US)

( * ) Notice: Subject to any disclaimer, the term of this patent is extended or adjusted under 35 U.S.C. 154(b) by 136 days.

(21) Appl. No.: 14/029,774

(22) Filed: Sep. 17, 2013

(65) Prior Publication Data

US 2015/0077240 A1 Mar. 19, 2015

(51) Int. Cl.

| | |
|---|---|
| ***G08B 23/00*** | (2006.01) |
| ***G08B 17/10*** | (2006.01) |
| ***G08B 3/10*** | (2006.01) |

(52) U.S. Cl.

CPC ..... *G08B 17/10* (2013.01); *G08B 3/10* (2013.01)

(58) Field of Classification Search

CPC ..... G08B 17/00; G08B 17/10; G08B 17/107; G08B 1/08; G08B 25/10; G08B 29/043; G08B 7/064; G08B 3/10; H04R 2420/07; H04R 1/028; H04R 3/00

See application file for complete search history.

(56) References Cited

U.S. PATENT DOCUMENTS

| | | | | |
|---|---|---|---|---|
| 4,827,244 A | | 5/1989 | Bellavia et al. | 340/514 |
| 5,424,587 A | * | 6/1995 | Federowicz | 307/140 |
| 5,596,648 A | * | 1/1997 | Fast | 381/77 |
| 5,745,040 A | * | 4/1998 | Loughridge | 340/628 |

(Continued)

FOREIGN PATENT DOCUMENTS

| | | | |
|---|---|---|---|
| CN | 203015204 U | 6/2013 | H05B 37/02 |
| EP | 0034562 A2 | 8/1981 | G08B 17/00 |

(Continued)

OTHER PUBLICATIONS

International Search Report and Written Opinion, Application No. PCT/US2014/055753, 8 pages, Nov. 6, 2014.

(Continued)

*Primary Examiner* — Kerri McNally
*Assistant Examiner* — Renee Dorsey
(74) *Attorney, Agent, or Firm* — Slayden Grubert Beard PLLC

(57) ABSTRACT

A smoke detector has enhanced audio and communications capabilities that allow audio content to be provided at each smoke detector location. This audio content may be music, intercom, doorbell actuation and radio programs. The smoke detector may also include a microphone for monitoring and two way communications between two or more smoke detectors, a intercom panel at a doorbell location, controlling lights in an area of the smoke detector with voice commands, and further providing for speakerphone answering and communications capabilities. Audio content and control may be provided to the smoke detector with a software program application running on a personal computer, tablet computer and a smart cell phone. A smoke detector may further be controlled with a Bluetooth or infrared handheld controller located in a area proximate to the smoke detector.

33 Claims, 7 Drawing Sheets

(56) References Cited

U.S. PATENT DOCUMENTS

| | | | | |
|---|---|---|---|---|
| 6,437,698 | B1 * | 8/2002 | Byrne et al. | 340/630 |
| 6,611,204 | B2 | 8/2003 | Schmurr | 340/538 |
| 6,741,174 | B2 | 5/2004 | Rhoades et al. | 340/540 |
| 6,930,596 | B2 | 8/2005 | Kulesz et al. | 340/506 |
| 7,042,352 | B2 | 5/2006 | Kates | 340/539.1 |
| 7,295,687 | B2 | 11/2007 | Kee et al. | 382/118 |
| 7,319,402 | B1 | 1/2008 | Sudderth | 340/628 |
| 7,512,247 | B1 * | 3/2009 | Odinak et al. | 381/312 |
| 7,576,659 | B2 | 8/2009 | Lax | 340/628 |
| 8,457,367 | B1 | 6/2013 | Sipe et al. | 382/118 |
| 8,466,800 | B1 | 6/2013 | Billman | 340/636.1 |
| 2001/0038336 | A1 | 11/2001 | Acevedo | 340/628 |
| 2003/0179096 | A1 | 9/2003 | Hanan | 340/628 |
| 2003/0229500 | A1 | 12/2003 | Morris | 704/275 |
| 2004/0110545 | A1 | 6/2004 | Kim | 455/575.1 |
| 2005/0040943 | A1 * | 2/2005 | Winick | 340/539.1 |
| 2005/0156731 | A1 | 7/2005 | Chapman, Jr. et al. | 340/521 |
| 2005/0195088 | A1 | 9/2005 | Solak et al. | 340/628 |
| 2005/0253709 | A1 | 11/2005 | Baker | 340/539.26 |
| 2005/0280526 | A1 | 12/2005 | Kalafarski | 340/510 |
| 2006/0082452 | A1 | 4/2006 | Kaiser et al. | 340/506 |
| 2007/0194906 | A1 | 8/2007 | Sink | 340/506 |
| 2008/0122929 | A1 | 5/2008 | Chukwu | 348/143 |
| 2010/0020166 | A1 * | 1/2010 | Levine et al. | 348/82 |
| 2010/0102957 | A1 | 4/2010 | Rutledge | 340/539.14 |
| 2010/0238036 | A1 | 9/2010 | Holcombe | 340/629 |
| 2011/0043367 | A1 | 2/2011 | Becker et al. | 340/577 |
| 2012/0210785 | A1 * | 8/2012 | Casey | 73/431 |
| 2013/0002687 | A1 * | 1/2013 | Conti | 345/501 |
| 2013/0117384 | A1 * | 5/2013 | Martch | 709/206 |
| 2013/0141587 | A1 | 6/2013 | Petricoin, Jr. | 348/156 |
| 2013/0147599 | A1 | 6/2013 | Becker et al. | 340/5.61 |
| 2013/0169430 | A1 * | 7/2013 | Shook | 340/539.1 |
| 2013/0170504 | A1 | 7/2013 | Shimokawa et al. | 370/429 |
| 2013/0342347 | A1 | 12/2013 | Huseth et al. | 340/539.16 |
| 2014/0256260 | A1 * | 9/2014 | Ueda et al. | 455/41.2 |
| 2014/0324232 | A1 * | 10/2014 | Modi et al. | 700/278 |

FOREIGN PATENT DOCUMENTS

| | | | | |
|---|---|---|---|---|
| GB | 2422506 | A | 7/2006 | G08B 13/196 |
| GB | 2471860 | A | 1/2011 | G08B 17/00 |
| WO | 02/071361 | A1 | 9/2002 | G08B 17/10 |

OTHER PUBLICATIONS

International Search Report and Written Opinion, Application No. PCT/US2014/055748, 13 pages, Jan. 7, 2015.

International Search Report and Written Opinion, Application No. PCT/US2014/055759, 16 pages, May 27, 2015.

U.S. Non-Final Office Action, U.S. Appl. No. 14/029,770, 20 pages, Aug. 11, 2015.

U.S. Non-Final Office Action, U.S. Appl. No. 14/029,770, 17 pages, Apr. 1, 2016.

U.S. Final Office Action, U.S. Appl. No. 14/029,770, 22 pages, Dec. 17, 2015.

* cited by examiner

SMOKE DETECTOR WITH ENHANCED AUDIO AND COMMUNICATIONS CAPABILITIES

TECHNICAL FIELD

The present disclosure relates to smoke detectors with additional capabilities, and, more particularly, to a smoke detector with enhanced audio and communications capabilities.

BACKGROUND

Many municipalities, states and countries may require smoke alarms through building codes, e.g., 2012 International Residential Code (IRC), in each sleeping room, outside each separate sleeping area in the immediate vicinity of the bedrooms, and on each additional story of the dwelling, including basements (IRC 314.3). Smoke detectors may be powered from the AC line and may have a battery backup. A single backup battery may be provided for a plurality of smoke detectors, e.g., in industrial installations where the one main battery backup may be used instead of a backup battery at each smoke alarm.

"Where more than one smoke alarm is required to be installed within an individual dwelling unit in accordance with IRC Section R314.3, the smoke alarm devices shall be interconnected in such a manner that the actuation of one smoke alarm will activate all of the smoke alarms in the individual unit (IRC 314.5). The building code required smoke alarms silently sit in place, hopefully never to be needed. Wouldn't it be nice to utilize these strategically located smoke detector devices having a supply of electrical power connected to them for other useful and advantageous purposes?

SUMMARY

Therefore, there is an opportunity for providing enhanced audio and communications capabilities in smoke detector devices required for providing smoke alarms that are strategically located in a home and having electrical power supplied thereto. Existing smoke detector devices may be easily replaced with smoke detector devices having enhanced audio and communications features and functions, and new construction installations may similarly benefit at minimal additional cost.

According to an embodiment, an apparatus for detecting smoke and having audio and communications capabilities may comprise: a logic device; a smoke sensor coupled to the logic device; a communications interface coupled to the logic device; an audio amplifier coupled to the logic device; a speaker coupled to the audio amplifier; and a power supply coupled to and powering the logic device, communications interface and audio amplifier; wherein when the smoke sensor detects smoke the logic device generates at least one smoke alarm tone through the audio amplifier and to the speaker, and a smoke alarm signal through the communications interface; wherein audio content may be provided through the communications interface, the logic device, the audio amplifier and to the speaker when there may be not a current smoke alarm.

According to a further embodiment, the communications interface may be coupled to a wired communications bus. According to a further embodiment, the wired communications bus may be an Ethernet local area network. According to a further embodiment, the communications interface may be a wireless interface coupled to a radio frequency antenna. According to a further embodiment, the communications interface may be adapted to communicate with a wireless local area network (WLAN). According to a further embodiment, the smoke sensor may be an ionization chamber smoke sensor. According to a further embodiment, the smoke sensor may be an optical smoke sensor. According to a further embodiment, the audio content may be music.

According to a further embodiment, a microphone and an audio interface may be coupled to the logic device and provide an audio input thereto. According to a further embodiment, the audio content may be selected from the group consisting of duplex communications between two smoke detectors, a doorbell location and a telephone. According to a further embodiment, a carbon monoxide sensor may be coupled to the logic device. According to a further embodiment, a carbon dioxide sensor may be coupled to the logic device. According to a further embodiment, an explosive gas detector may be coupled to the logic device. According to a further embodiment, a hazardous gas detector may be coupled to the logic device. According to a further embodiment, a heat detector may be coupled to the logic device. According to a further embodiment, a Bluetooth receiver may be may be coupled to the logic device and adapted for control of the audio content coupled thereto. According to a further embodiment, an infrared (IR) receiver may be coupled to the logic device and adapted for control of the audio content coupled thereto.

According to a further embodiment, a removable memory module port coupled to the logic device and adapted for receiving a removable memory module. According to a further embodiment, the removable memory module port may be a USB interface and the removable memory module may be a solid state memory stick. According to a further embodiment, the removable memory module may be a secure digital (SD) drive. According to a further embodiment, a temperature sensor coupled to the logic device. According to a further embodiment, a relative humidity sensor coupled to the logic device. According to a further embodiment, the logic device may be a microcontroller. According to a further embodiment, the logic device may be selected from the group consisting of a microprocessor, a digital signal processor (DSP), an application specific integrated circuit (ASIC), and a field programmable gate array (FPGA).

According to another embodiment, a system for communicating with smoke detectors having audio and communications capabilities may comprise: a plurality of smoke detectors, each smoke detector may comprise a logic device, a smoke sensor coupled to the logic device, a communications interface coupled to the logic device, an audio amplifier coupled to the logic device, a speaker coupled to the audio amplifier, and a power supply coupled to and powering the logic device, communications interface and audio amplifier; wherein when a smoke sensor detects smoke the associated logic device generates at least one smoke alarm tone through the audio amplifier and to the speaker of the associated one of the plurality of smoke detectors, and a smoke alarm signal through the communications interface; wherein audio content may be provided through the communications interface, the logic device, the audio amplifier and to the speaker when there may be not a current smoke alarm.

According to a further embodiment, each of the plurality of smoke detectors may comprise a microphone and an audio interface coupled to the logic device and provide an audio input thereto. According to a further embodiment, the audio content may be selected from the group consisting of duplex communications between two smoke detectors, a doorbell location and a telephone. According to a further embodiment, the audio content may be selected from the group consisting of music, voice, and actuation of a doorbell button. According to a further embodiment, a control unit may provide the audio content to the plurality of smoke detectors.

According to a further embodiment, a Bluetooth receiver may be adapted for coupling control information to the logic device; and a Bluetooth controller may be provided for controlling the logic device of a smoke detector located in an area proximate to the Bluetooth controller. According to a further embodiment, an infrared (IR) receiver may be adapted for coupling control information to the logic device; and an IR controller may be provided for controlling the logic device of the smoke detector located in an area proximate to the IR controller.

According to a further embodiment, the control unit may be selected from the group consisting of a personal computer, a tablet touch screen computer, and a smart cell phone. According to a further embodiment, lights may be controlled with voice commands to the smoke detector in an area of the lights. According to a further embodiment, a removable memory module port may be coupled to the logic device and adapted for receiving a removable memory module. According to a further embodiment, the logic device may comprise a microcontroller. According to a further embodiment, the logic device may be selected from the group consisting of a microprocessor, a digital signal processor (DSP), an application specific integrated circuit (ASIC), and a field programmable gate array (FPGA).

BRIEF DESCRIPTION OF THE DRAWINGS

A more complete understanding of the present disclosure may be acquired by referring to the following description taken in conjunction with the accompanying drawings wherein.

Figure 1:
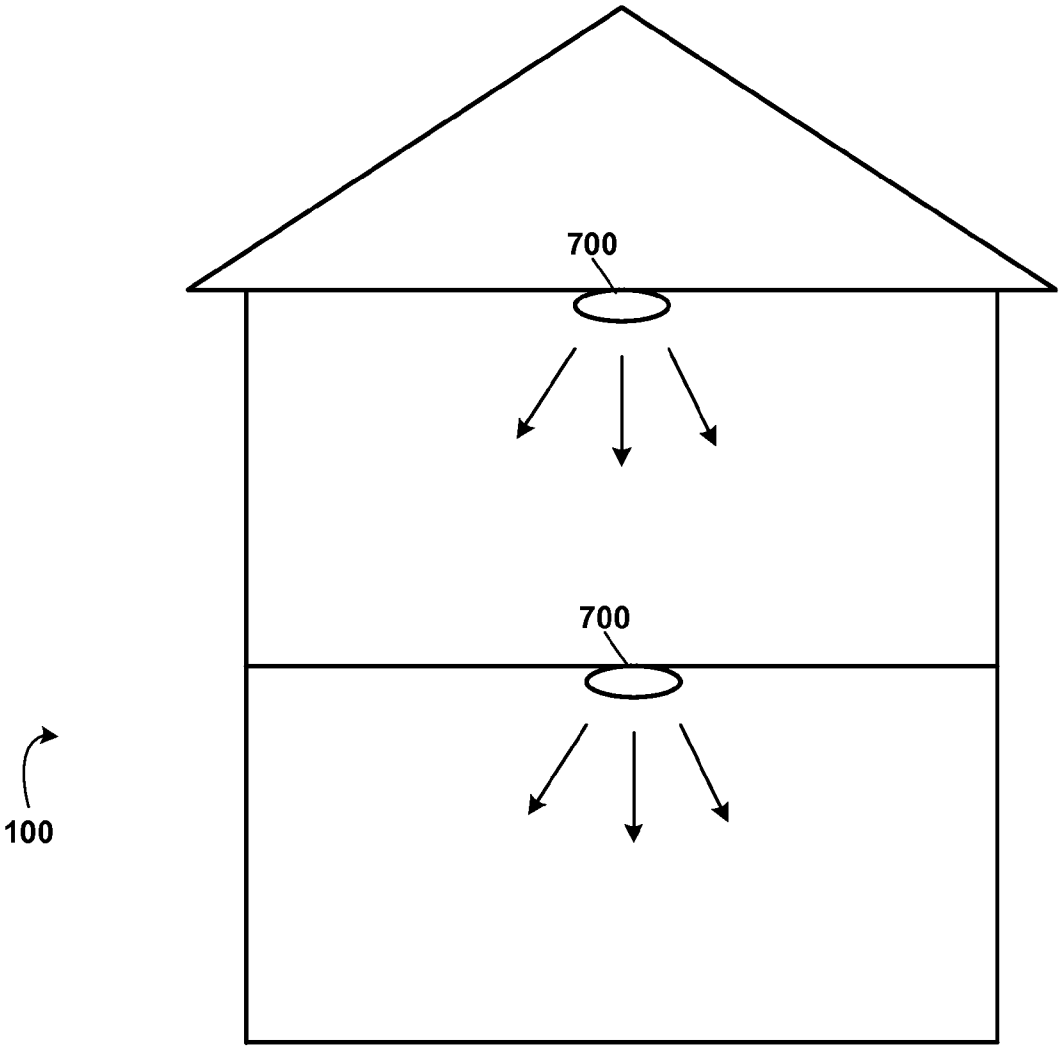
FIG. 1 illustrates a schematic elevational diagram of smoke detectors with enhanced audio and communications capabilities in a dwelling, according to a specific example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

According to various embodiments, an apparatus may comprise both smoke detector and audio capabilities. This apparatus may replace existing smoke detector devices and/or be used in new construction so as to provide both smoke detection and audio features in an area proximate to the device. It is contemplated and within the scope of this disclosure that carbon monoxide (CO), carbon dioxide ($CO_2$), explosive gas, hazardous gas and heat monitoring and alarm may also be provided and configured according the teachings of this disclosure. Audio features may be provided in the smoke detector apparatus such as, but are not limited to, networked speakers for distribution of music, intercom, telephone, and/or doorbell annunciation. According to the building codes, smoke detector outlets must provide electrical power and a networked connection for simultaneous smoke alarm actuation in a building if the smoke alarm devices are not approved for wireless actuation. Having electrical power at the smoke detector outlet allows high power demand audio amplifiers to be used with a speaker(s) integral with or remote from the smoke detector device. The smoke alarm network connection may also be used to carry audio signal content, either digital or analog, or a combination thereof, e.g., Ethernet local area network (LAN).

It is also contemplated and within the scope of this disclosure that the audio signal content and/or smoke alarm notification actuation may be provided by wireless transmission, e.g., wireless LAN (WLAN), WiFi, Zigbee, etc. Different audio content may be provided at each smoke detector device location and may be controlled through a central control point using a software program application (App) with, for example but not limited to, a personal computer, tablet computer, smart cell phone, iPod, etc. Each smoke detector may be adapted to receive a removable memory module, e.g., a solid state memory stick, e.g., USB thumb drive; secure digital (SD) drive, etc., with a removable memory module port. The removable memory module may remain in place with its associated smoke alarm or may down load its contents into a memory in the smoke detector and then be removed. The removable memory module may store preprogrammed announcements when a smoke alarm occurs and/or preprogrammed music or other audio content, e.g., white noise, lullaby's, poetry, exercise routines, etc., for playing through the smoke detector speaker at requested and/or preprogrammed times. E.g., baby lullaby's playing for example but not limited to one half hour, wake-up alerts, etc.

Individual smoke detector devices may have paired, coded, hand held control transmitters, e.g., infra-red (IR), Bluetooth, etc., located in the area of the controlled smoke detector/audio device to allow a person to select audio content, e.g., music, radio, intercom, speaker phone, etc., in that area, e.g., bedroom, kitchen, den, etc.; and/or respond to an intercommunications (intercom) query, and/or converse with a person at a door who has actuated a doorbell button. Two or more smoke detector devices having audio capabilities may be configured to monitor at least one area, one used for audio pickup in and the other for audio monitoring of, e.g., a baby nursery, small child play area, pool area, etc.

Each smoke detector having audio capabilities may be used to annunciate a security alert upon detection of a home break-in, provide audio evacuation instructions upon a smoke alert, control air conditioning equipment, e.g., having internal sensor(s) for temperature and/or relative humidity (RH); and/or turn on and off lights in an area of the smoke detector through voice commands.

Referring now to the drawing, the details of specific example embodiments are schematically illustrated. Like elements in the drawings will be represented by like numbers, and similar elements will be represented by like numbers with a different lower case letter suffix.

Referring to FIG. 1, depicted is a schematic elevational diagram of smoke detectors with enhanced audio and communications capabilities in a dwelling, according to a specific example embodiment of this disclosure. A dwelling, generally represented by the numeral 100, has a smoke detector 700 with audio capabilities in each room thereof as required by building codes. Electrical power (not shown) is supplied to each smoke detector 700 and either a wired communications bus (not shown), e.g., Ethernet local area network (LAN) cabling, etc., or a code approved wireless communications link, e.g., WLAN, WiFi, Zigbee, etc., may be used to communicate smoke alarm actuation, as required by the building code, and couple audio, e.g., music, intercom voice paging, doorbell annunciation, etc., to an audio transducer, e.g., speaker, portion of the smoke detector 700. The smoke detectors 700 may further provide audio evacuation instructions that may be prerecorded or live audio from a fire or building official. Prerecorded instructions and/or audio content may also be stored in a removable memory module 744 coupled to a logic device 726 (see FIG. 7).

Figure 2:
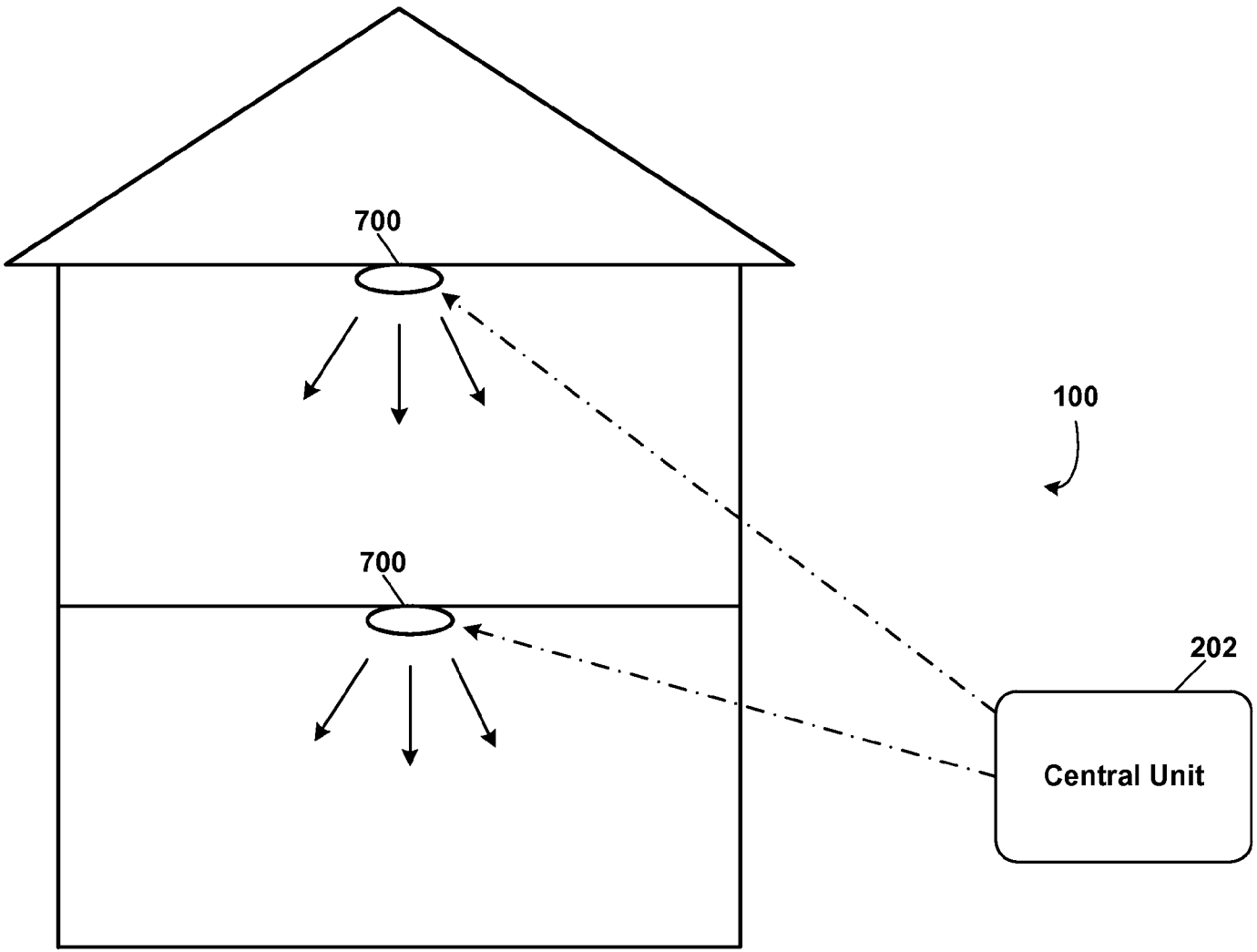
FIG. 2 illustrates a schematic elevational diagram of smoke detectors with enhanced audio and communications capabilities in a dwelling that may be controlled with a central control unit, according to another specific example embodiment of this disclosure.

Referring to FIG. 2, depicted is a schematic elevational diagram of smoke detectors with enhanced audio and communications capabilities in a dwelling that may be controlled with a central control unit, according to another specific example embodiment of this disclosure. The smoke detectors 700 with enhanced audio capabilities may comprise at least all of the features shown in FIG. 1 and described hereinabove. In addition, a central unit 202, e.g., personal computer, a digital disc player (e.g., CD, DVD, Blu-ray, etc.), tablet computer, home entertainment system, etc., may provide audio content to each smoke detector 700. The central unit 202 may provide different and customized audio content to each smoke detector 700. The central unit 202 may be hardwired, e.g., communication and signal cable (e.g., twisted pairs)(not shown), or connected wirelessly, e.g., WLAN, WiFi, etc., to each smoke detector 700. The smoke detectors 700 may further provide audio evacuation instructions that may be prerecorded in the central unit 202 or live audio from a fire or building official. Prerecorded instructions and/or audio content may also be stored in a removable memory module 744 coupled to a logic device 726 (see FIG. 7).

Figure 3:
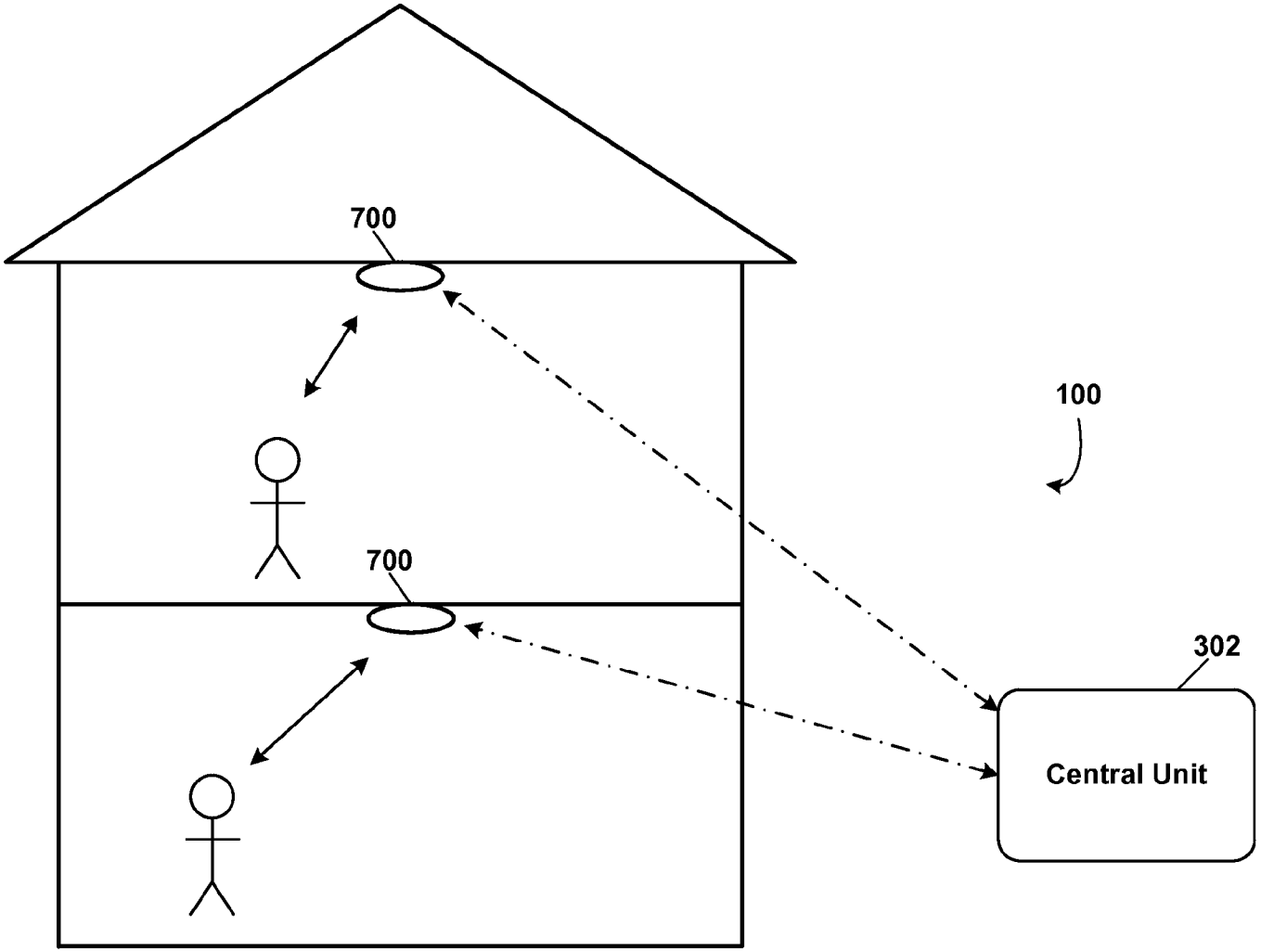
FIG. 3 illustrates a schematic elevational diagram of smoke detectors with enhanced audio and two-way communications capabilities in a dwelling that may be controlled with a central control unit, according to yet another specific example embodiment of this disclosure.

Referring to FIG. 3, depicted is a schematic elevational diagram of smoke detectors with enhanced audio and two-way communications capabilities in a dwelling that may be controlled with a central control unit, according to yet another specific example embodiment of this disclosure. The smoke detectors 700 with enhanced audio capabilities may comprise at least all of the features shown in FIGS. 1 and 2, and described hereinabove. A central unit 302, e.g., personal computer, tablet computer, home entertainment system, etc., may provide audio content to, from and/or between each smoke detector 700, e.g., paging or intercom between detectors 700, telephone answering and talking, communications with doorbell located speaker/microphone (not shown), etc. Voice commands may be utilized to the answer the telephone or initiate and dial a call therewith. Voice commands may also be utilized to initiate communications with a person at the doorbell location and even unlock the door upon a coded command. Lights and/or air conditioning may be adjusted or turned on or off with voice commands through the smoke detectors 700 and central control unit 302. Messages may be recorded and stored in the central unit 302 for providing audio evacuation instructions during a smoke alarm event. Prerecorded instructions and/or audio content may also be stored in a removable memory module 744 coupled to a logic device 726 (see FIG. 7).

Figure 4:
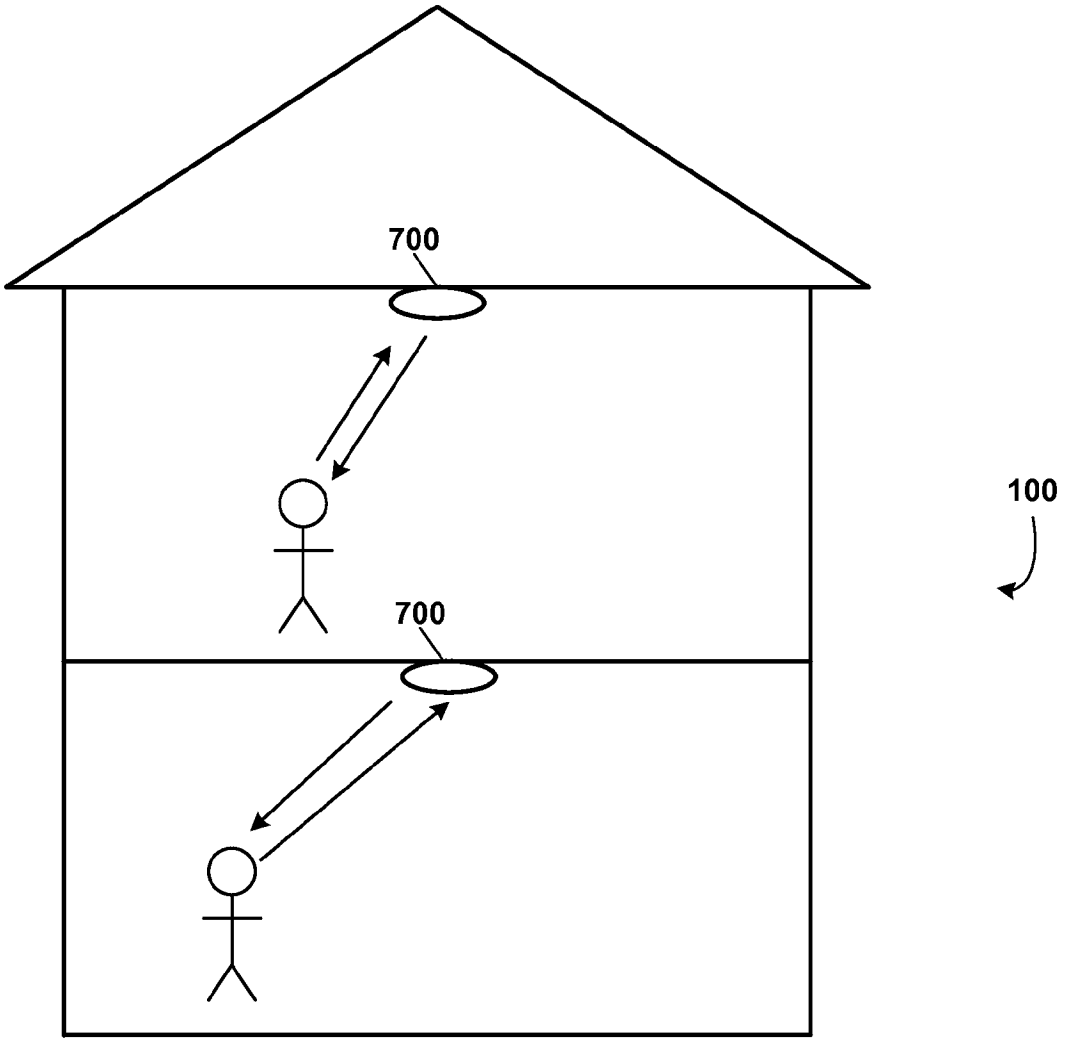
FIG. 4 illustrates a schematic elevational diagram of smoke detectors with enhanced audio and two-way communications capabilities in a dwelling, according to still another specific example embodiment of this disclosure.

Referring to FIG. 4, depicted is a schematic elevational diagram of smoke detectors with enhanced audio and two-way communications capabilities in a dwelling, according to still another specific example embodiment of this disclosure. The smoke detectors 700 with enhanced audio capabilities may comprise at least all of the features shown in FIG. 1, and described hereinabove. And in addition may provide audio content to, from and/or between each smoke detector 700, e.g., paging or intercom between detectors 700. Messages may be recorded and stored in each smoke detector 700 for providing audio evacuation instructions during a smoke alarm event. Prerecorded instructions and/or audio content may also be stored in a removable memory module 744 coupled to a logic device 726 (see FIG. 7).

Figure 5:
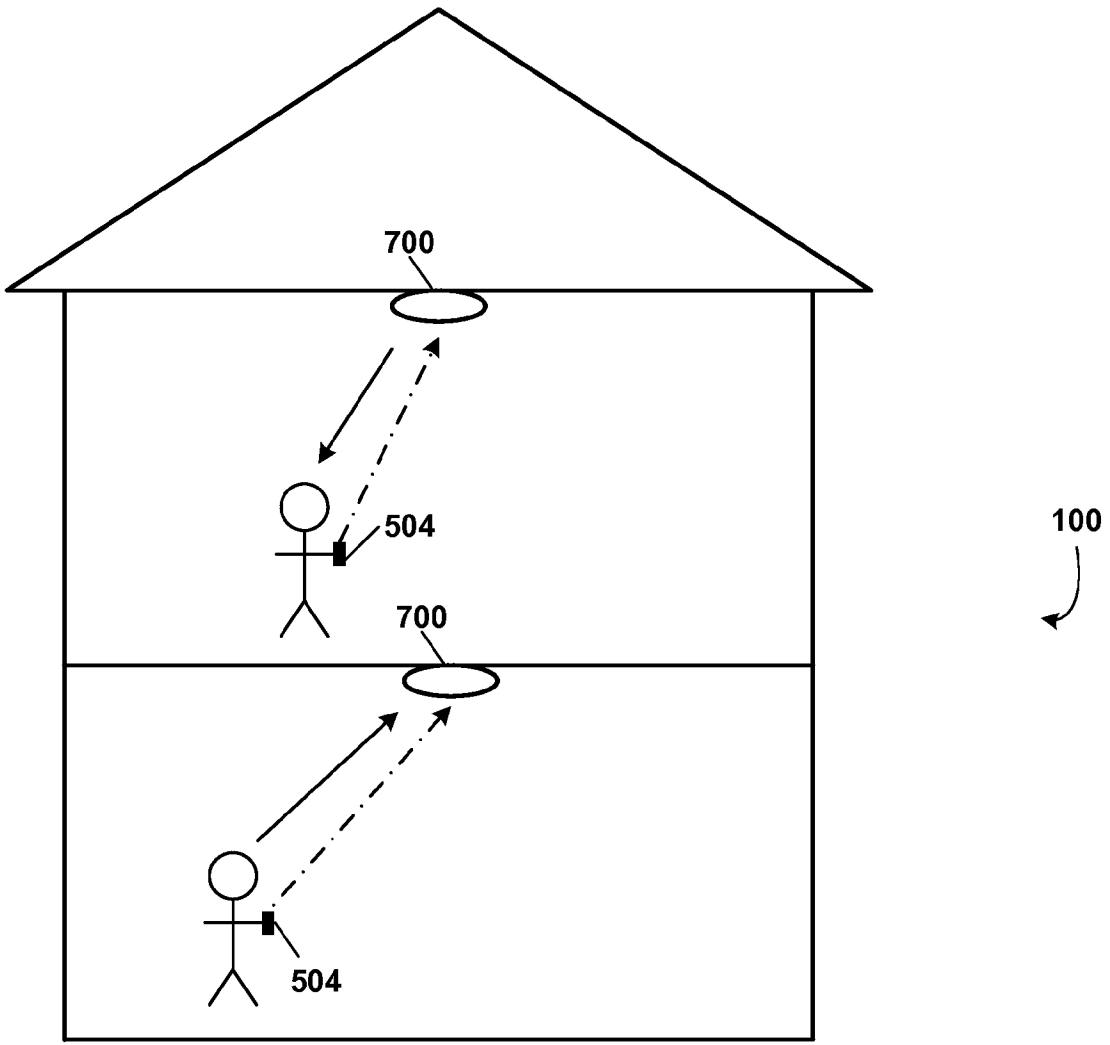
FIG. 5 illustrates a schematic elevational diagram of smoke detectors with enhanced audio and two-way communications capabilities in a dwelling that may be controlled with local control units, according to another specific example embodiment of this disclosure.

Referring to FIG. 5, depicted is a schematic elevational diagram of smoke detectors with enhanced audio and two-way communications capabilities in a dwelling that may be controlled with local control units, according to another specific example embodiment of this disclosure. The smoke detectors 700 with enhanced audio capabilities may comprise at least all of the features shown in FIGS. 1 and 4, and described hereinabove. A local handheld wireless controller 504, e.g., Bluetooth, infrared (IR), may be used to control the operation of each respective smoke detector 700 as to music content, paging, intercom functions, telephone answering and talking, doorbell communications, etc. A music, voice, doorbell, and/or telephone interface (not shown) may be used to facilitate the aforementioned functions with the smoke detectors 700 via either wired, e.g., Ethernet LAN, etc., and/or wireless, e.g., WiFi, WLAN, etc. Messages may be recorded and stored in each smoke detector 700 for providing audio evacuation instructions during a smoke alarm event. Prerecorded instructions and/or audio content may also be stored in a removable memory module 744 coupled to a logic device 726 (see FIG. 7).

Figure 6:
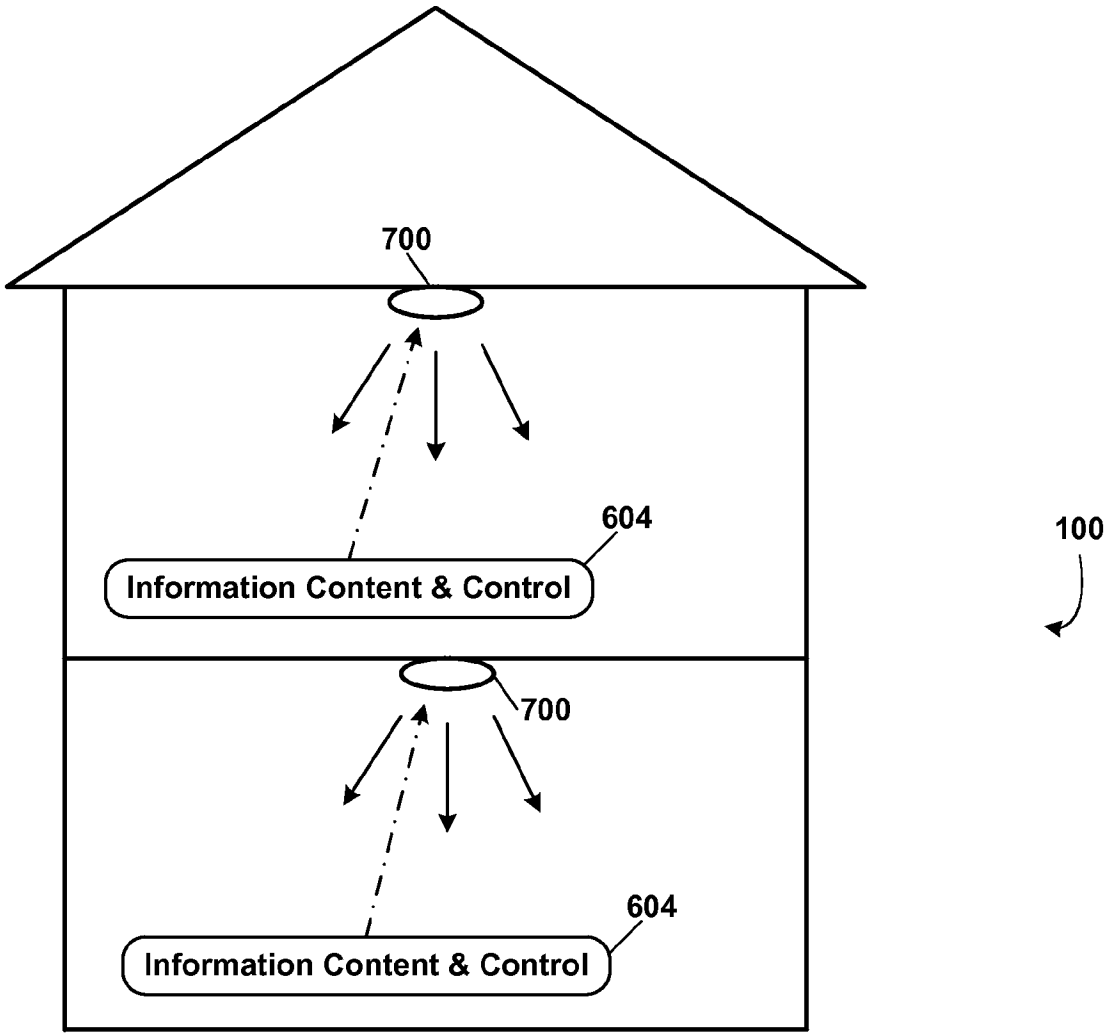
FIG. 6 illustrates a schematic elevational diagram of smoke detectors with enhanced audio and communications capabilities in a dwelling that may be locally controlled for information and content, according to another specific example embodiment of this disclosure.

Referring to FIG. 6, depicted is a schematic elevational diagram of smoke detectors with enhanced audio and communications capabilities in a dwelling that may be locally controlled for information and content, according to another specific example embodiment of this disclosure. The smoke detectors 700 with enhanced audio capabilities may comprise at least all of the features shown in FIGS. 1 through 5, and described hereinabove. A local information and control unit 604, e.g., personal computer, touch pad tablet computer, smart cell phone, clock radio, etc., may be used in each area of a respective smoke detector 700 for providing information content and control thereto. Control and communications from the local information and control unit 604 may be through wired or wireless communications, e.g., Bluetooth, Ethernet LAN, WLAN, WiFi, etc. The local information and control units 604 may provide music and/or voice to the respective smoke detectors 700 from radio stations, recordings, Internet, etc. The smoke detectors 700 may further provide audio evacuation instructions that may be prerecorded in the local information and control unit 604 or live audio from a fire or building official. Prerecorded instructions and/or audio content may also be stored in a removable memory module 744 coupled to a logic device 726 (see FIG. 7).

Figure 7:
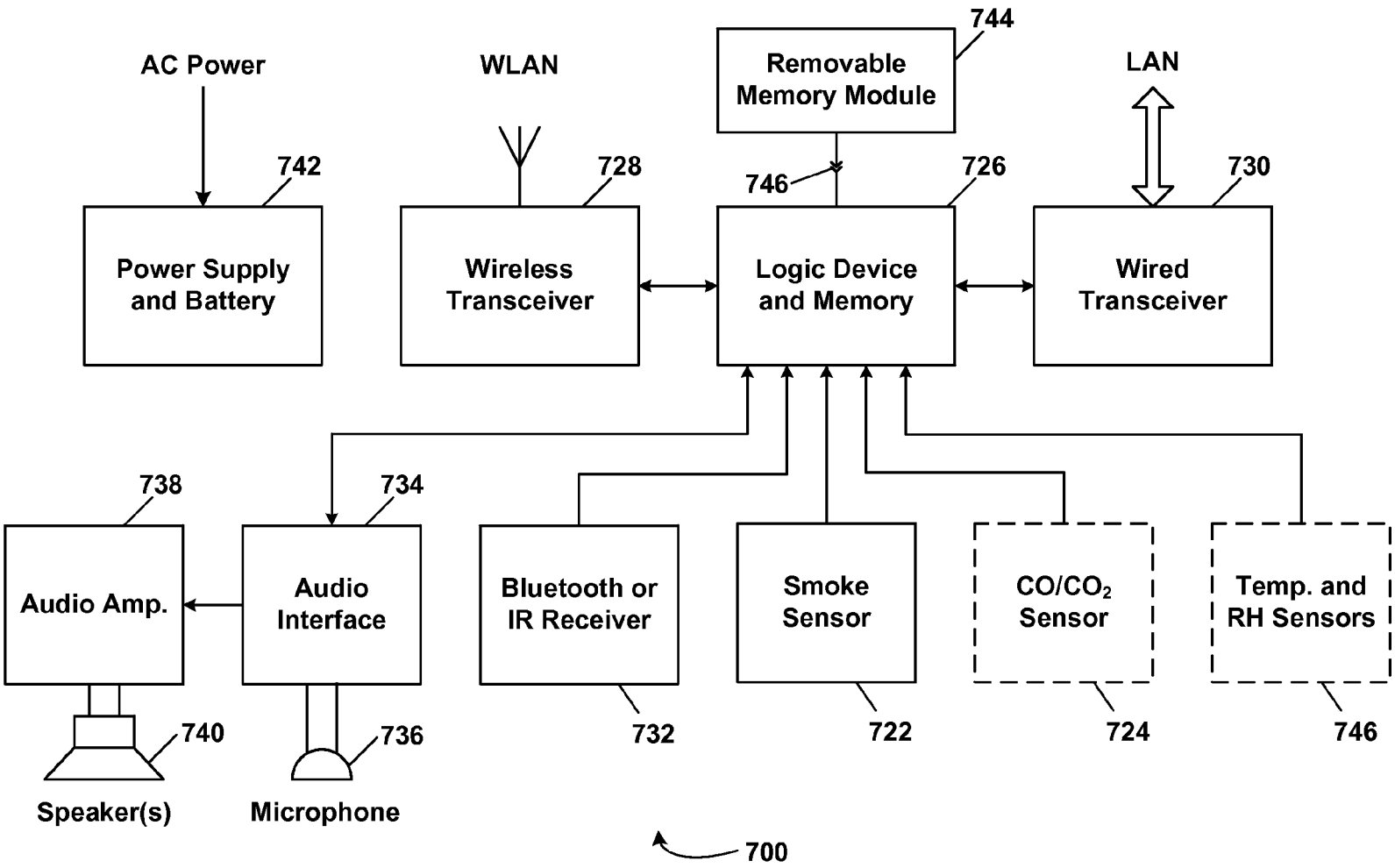
FIG. 7 illustrates a schematic block diagram of a smoke detector with enhanced audio and communications capabilities, according to specific example embodiments of this disclosure.

Referring to FIG. 7, depicted is a schematic block diagram of a smoke detector having enhanced audio and communications capabilities, according to specific example embodiments of this disclosure. A smoke detector having enhanced audio and communications capabilities, generally represented by the numeral 700, may comprise a smoke sensor 722, a carbon monoxide and/or carbon dioxide sensor(s) 724, a temperature and/or relative humidity (RH) sensor(s) 746, a logic device 726 having a memory, a wireless transceiver 728 coupled to an antenna and/or a wired transceiver 730 coupled to a wired local area network (LAN), a Bluetooth and/or an infrared (IR) receiver 732, an audio interface 734, a microphone 736, an audio amplifier 738, a speaker(s) 740, and a power supply and battery 742. Provisions for coupling to a removable memory module 744 may be provided in the smoke detector 700 with a removable memory module port 746. The logic device 726 may be, for example but is not limited to, a microcontroller, a microprocessor, a digital signal processor (DSP), an application specific integrated circuit (ASIC), a field programmable gate array (FPGA), etc., and may have both digital and analog capabilities.

The smoke sensor 722 may be an ionization and/or optical smoke sensor, and the like. The sensor 724 may be a carbon monoxide and/or carbon dioxide sensor(s); explosive gas, hazardous gas, and/or heat sensor(s), etc. The audio interface may allow for either half or full duplex operation with the microphone 736 and the audio amplifier 738/speaker 740. The power supply 742 with battery backup may be powered from the house alternating current (AC) power electrical branch circuits. The logic device 726 may comprise mixed signal (analog and digital) capabilities, a program and storage memory (not shown). The wireless transceiver 728 and/or wired transceiver 730 may be part of or separate from the logic device 726. It is contemplated and within the scope of this disclosure that substitution for the logic device 726 may be an application specific integrated circuit (ASIC), a programmable logic array, a microprocessor, a digital signal processor (DSP), etc. One having ordinary skill in integrated circuit design and having the benefit of this disclosure could come up with an effective design using mixed signal integrated circuit devices.

Activation of a smoke and/or carbon monoxide/dioxide or other hazardous condition detection warning alarm may be initiated by the logic device 726 sensing the outputs from the smoke sensor 723 and/or $CO/CO_2$ sensor 724. The logic device 726 may further signal other smoke detectors 700 of the detected smoke alarm to meet building code requirements via the wired transceiver 730 over a code approved wired communications line, e.g., Ethernet LAN, etc., and/or the wireless transceiver 728 over a code approved WLAN, WiFi, etc., signal. In addition, prerecorded evacuation messages may be stored in the memory of the logic device 726.

Music and/or voice content may be coupled to the logic device 726 via the wired transceiver 730, the wireless transceiver 728, and/or the Bluetooth receiver 732. Simplex (one way) or duplex (two way) communications may be used between two or more smoke detectors 700, a speaker/microphone at a entrance door (doorbell interface), and/or a telephone line for speakerphone operation. Music and/or audio may be transmitted from the speaker(s) 740 to an occupant(s) of an area (room) proximate to the smoke detector 700 from the logic device 726 after being amplified by the audio amplifier 738. Audio (voice) from the occupant(s) of the area (room) proximate to the smoke detector 700 may be picked up by the microphone 736 and coupled into the logic device 726 via the audio interface 734. The audio interface 734 may also provide duplex operation of a voice conversation between two smoke detectors 700, a smoke detector 700 and a doorbell communications interface (not shown), and/or a telephone.

The smoke detector 700 may be adapted to receive a removable memory module 744, e.g., USB thumb drive, secure digital (SD) drive, etc., with a removable memory module port 746. The removable memory module 744 may remain in place with its associated smoke alarm or may down load its contents into a memory (e.g., memory of logic device 726) in the smoke detector 700 and then be removed. The removable memory module 744 may store preprogrammed announcements when a smoke alarm occurs and/or preprogrammed music or other audio content, e.g., white noise, lullaby's, poetry, exercise routines, etc., for playing through the smoke detector speaker at requested and/or preprogrammed times. E.g., baby lullaby's playing for example but not limited to one half hour, wake-up alerts, etc.

The temperature and/or relative humidity sensor(s) 746 may be used to provide local sensing and control for heating, ventilation and cooling (HVAC) equipment, and/or indoor air quality (IAQ), e.g., whole house dehumidification using the relative humidity sensor 746, and/or fresh air ventilation control using the carbon dioxide sensor 724.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. An apparatus for detecting smoke and having audio and communications capabilities, comprising:

a logic device;

a smoke sensor coupled to the logic device;

a local area network (LAN) communications interface coupled to the logic device, wherein the LAN communications interface is coupled to an Ethernet local area wired communications bus and/or wherein the LAN communications interface comprises a wireless interface coupled to a radio frequency antenna;

an audio amplifier coupled to the logic device;

a speaker coupled to the audio amplifier; and a power supply coupled to and powering the logic device, communications interface and audio amplifier;

wherein the apparatus is configured to be installed in a dwelling;

wherein when the smoke sensor detects smoke the logic device generates at least one smoke alarm tone through the audio amplifier and to the speaker, and a smoke alarm signal through the communications interface;

wherein audio content is provided through the LAN communications interface, the logic device, the audio amplifier and to the speaker when there is not a current smoke alarm.

2. The apparatus according to claim 1, wherein the LAN communications interface is adapted to communicate with a wireless local area network (WLAN).

3. The apparatus according to claim 1, wherein the smoke sensor is an ionization chamber smoke sensor.

4. The apparatus according to claim 1, wherein the smoke sensor is an optical smoke sensor.

5. The apparatus according to claim 1, wherein the audio content is music.

6. The apparatus according to claim 1, further comprising a microphone and an audio interface coupled to the logic device and providing an audio input thereto.

7. The apparatus according to claim 6, wherein the audio content is selected from the group consisting of duplex communications between two smoke detectors, a doorbell location and a telephone.

8. The apparatus according to claim 1, further comprising a carbon monoxide sensor coupled to the logic device.

9. The apparatus according to claim 1, further comprising a carbon dioxide sensor coupled to the logic device.

10. The apparatus according to claim 1, further comprising an explosive gas detector coupled to the logic device.

11. The apparatus according to claim 1, further comprising a hazardous gas detector coupled to the logic device.

12. The apparatus according to claim 1, further comprising a heat detector coupled to the logic device.

13. The apparatus according to claim 1, further comprising a Bluetooth receiver adapted for control of the audio content coupled to the logic device.

14. The apparatus according to claim 1, further comprising an infrared (IR) receiver adapted for control of the audio content coupled to the logic device.

15. The apparatus according to claim 1, further comprising a removable memory module port coupled to the logic device and adapted for receiving a removable memory module.

16. The apparatus according to claim 15, wherein the removable memory module port is a USB interface coupled to the logic device and the removable memory module is a solid state memory stick.

17. The apparatus according to claim 15, wherein the removable memory module is a secure digital (SD) drive coupled to the logic device.

18. The apparatus according to claim 1, further comprising a temperature sensor coupled to the logic device.

19. The apparatus according to claim 1, further comprising a relative humidity sensor coupled to the logic device.

20. The apparatus according to claim 1, wherein the logic device comprises a microcontroller.

21. The apparatus according to claim 1, wherein the logic device is selected from the group consisting of a microprocessor, a digital signal processor (DSP), an application specific integrated circuit (ASIC), and a field programmable gate array (FPGA).

22. A system for communicating with smoke detectors having audio and communications capabilities, said system comprising:

a plurality of smoke detectors configured to be installed in a dwelling, each smoke detector comprising a logic device, a smoke sensor coupled to the logic device, a local area network (LAN) communications interface coupled to the logic device, wherein the LAN communications interface is coupled to an Ethernet local area wired communications bus and/or wherein the LAN communications interface comprises a wireless interface coupled to a radio frequency antenna;

an audio amplifier coupled to the logic device, a speaker coupled to the audio amplifier, and a power supply coupled to and powering the logic device, the LAN communications interface and the audio amplifier;

wherein when a smoke sensor detects smoke the associated logic device generates at least one smoke alarm tone through the audio amplifier and to the speaker of the associated one of the plurality of smoke detectors, and a smoke alarm signal through the LAN communications interface;

wherein audio content is provided through the LAN communications interface, the logic device, the audio amplifier and to the speaker when there is not a current smoke alarm.

23. The system according to claim 22, where each of the plurality of smoke detectors further comprising a microphone and an audio interface coupled to the logic device and providing an audio input thereto.

24. The system according to claim 23, wherein the audio content is selected from the group consisting of duplex communications between two smoke detectors, a doorbell location and a telephone.

25. The system according to claim 22, wherein the audio content is selected from the group consisting of music, voice, and actuation of a doorbell button.

26. The system according to claim 23, wherein a control unit provides the audio content to the plurality of smoke detectors.

27. The system according to claim 22, further comprising:

a Bluetooth receiver adapted for coupling control information to the logic device; and a Bluetooth controller for controlling the logic device of a smoke detector located in an area proximate to the Bluetooth controller.

28. The system according to claim 22, further comprising:

an infrared (IR) receiver adapted for coupling control information to the logic device; and an IR controller for controlling the logic device of a smoke detector located in an area proximate to the IR controller.

29. The system according to claim 26, wherein the control unit is selected from the group consisting of a personal computer, a tablet touch screen computer, and a smart cell phone.

30. The system according to claim 23, wherein lights are controlled with voice commands to the smoke detector in an area of the lights.

31. The system according to claim 22, further comprising a removable memory module port coupled to the logic device and adapted for receiving a removable memory module.

32. The apparatus according to claim 22, wherein the logic device comprises a microcontroller.

33. The apparatus according to claim 22, wherein the logic device is selected from the group consisting of a microprocessor, a digital signal processor (DSP), an application specific integrated circuit (ASIC), and a field programmable gate array (FPGA).

* * * * *